US006691539B2

(12) United States Patent
Jacob et al.

(10) Patent No.: US 6,691,539 B2
(45) Date of Patent: Feb. 17, 2004

(54) COMBINED MECHANICAL AND ELECTRONIC KEY, IN PARTICULAR FOR LOCKS IN A VEHICLE

(75) Inventors: Dirk Jacob, Heiligenhaus (DE); Ulrich Müller, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/168,427

(22) PCT Filed: Dec. 8, 2000

(86) PCT No.: PCT/EP00/12431

§ 371 (c)(1),
(2), (4) Date: Jun. 21, 2002

(87) PCT Pub. No.: WO01/48342

PCT Pub. Date: Jul. 5, 2001

(65) Prior Publication Data

US 2003/0000267 A1 Jan. 2, 2003

(30) Foreign Application Priority Data

Dec. 24, 1999 (DE) ..... 199 62 976

(51) Int. Cl.[7] ..... A44B 15/00
(52) U.S. Cl. ..... 70/408; 70/456 R; 70/459
(58) Field of Search ..... 70/396, 397, 399, 70/413, 278.3, 257, 408, 456 R, 459, 395; 206/37.1, 37.2, 37.3, 37.4, 37.5, 38.1

(56) References Cited

U.S. PATENT DOCUMENTS 2,822,684 A * 2/1958 Ray
3,613,414 A * 10/1971 Ostrager
4,524,594 A * 6/1985 Bascou ..... 70/456 R
4,726,205 A 2/1988 Allerdist et al. ..... 70/395
4,852,374 A * 8/1989 Gotanda ..... 70/456 R
4,888,970 A * 12/1989 Kinzler et al. ..... 70/456 R
4,922,736 A * 5/1990 Tanaka et al. ..... 70/277
4,939,917 A * 7/1990 Cartwright ..... 70/456 R
5,819,568 A * 10/1998 Christie et al. ..... 70/395
5,943,889 A * 8/1999 Chiu ..... 70/456 R
6,016,676 A * 1/2000 McConnell ..... 70/408
6,460,386 B1 * 10/2002 Watanuki et al. ..... 70/456 R
6,474,123 B1 * 11/2002 Kito et al. ..... 70/456 R
6,499,326 B1 * 12/2002 Heussner ..... 70/399

FOREIGN PATENT DOCUMENTS

DE 3902537 8/1990
EP 0267429 5/1988

* cited by examiner

*Primary Examiner*—Lloyd A. Gall
(74) *Attorney, Agent, or Firm*—Friedrich Kueffner

(57) ABSTRACT

In a combined mechanical and electronic key, electronic components and mechanical flat keys (30) are normally housed in a common key holder (10). In order to place the flat key (30) between a lowered rest position in a holder (10) and a projecting in-use position, the flat key (30) is movably located in a container (10) and secured in at least one of the positions by a push button (40). The key contain is assembled from an upper and a lower shell. In order to avoid sealing problems between both shells, according to the invention, the upper shell (11) is provided with an outbreak in a region pertaining thereto which lies outwith the push button. The outbreak creates a void chamber which can be accessed from the outside and is located on the inside of the shell interior. The electronic components are enclosed by a housing-like capsule and form therewith a prefabricated electrocapsule (20). The electrocapsule (20) forms a socket unit, which can be inserted thereafter in the void chamber pertaining to the pre-assembled key container (10). The electrocapsules (10) are secured in the key container (10) when inserted in the socket. The push button (40) is used to advantage for securing.

15 Claims, 5 Drawing Sheets

COMBINED MECHANICAL AND ELECTRONIC KEY, IN PARTICULAR FOR LOCKS IN A VEHICLE

BACKGROUND OF THE INVENTION

1. Field of the Invention

The invention pertains to a combination key of the type indicated in the introductory clause of claim 1. A key of this type makes it possible to actuate locks directly in a mechanical manner but also, either alternatively or supplementally, to actuate them electronically, e.g., to actuate the particular lock in question or other locks from a remote location. The key container itself represents the means by which the key is actuated both mechanically and electrically. For the purpose of electronic actuation, therefore, the key container has actuating points on its outside surface in the form of, for example, electrical push buttons or resilient membranes, which act on electrical switches or the like provided inside the container. The flat mechanical key is held with freedom of movement in the interior of the container and can be moved from a home position, recessed in the container, to a working position, projecting out of the container. So that the flat key can be held securely in its two positions, it is recommended that it be latched in both positions by a push button mounted in the container and spring-loaded in the axial direction.

2. Description of the Related Art

In the known key of this type (DE 39 02 537 C2), not only the mechanical flat key but also the electronic components for electronic actuation are installed directly in the interior of the key container. The electronic components also include the batteries which supply the necessary power, and after a certain period of use they must be replaced. For this reason, the key container consists of an upper shell and a lower shell, which can be detached from each other when necessary. It is a difficult and time-consuming process to disassemble and then reassemble the shell parts. So that the flat key can remain hidden in the interior of the container when in the home position, a lateral recess is provided in the key container, out of which the mechanical flat key travels as it proceeds to its working position. As a result of the joint between the upper shell and the lower shell, dirt and moisture can enter the interior of the container, for which reason it is important to provide a good seal at this point. This seal, however, is not always guaranteed after prolonged use, especially after electronic components or batteries have been replaced. The removal of the electronic components and batteries from the interior of the housing and their reinstallation is laborious and time-consuming. When the two shells of the key container are taken apart and put back together again, there is also the danger that the seal will not be located properly or that it will be damaged. A similar solution suffering from the same disadvantages is described in EP 0 267 429 A1.

It is also known from GB 2 080 386 A that a cartridge can be mounted on top of a mechanical key. The cartridge, which consists of two shells and contains a light source, forms a housing-like capsule and can be inserted as a plug-in unit or attached at a later time. For this purpose the key grip has an opening, which forms a free space accessible from the outside. The disadvantage of this design is that the plug-in unit is not secured in the plugged-in position and can easily come loose from its seat.

SUMMARY OF THE INVENTION

The invention is based on the task of developing a reliable, space-saving key of the type indicated above, which presents no sealing problems and which makes it easy to replace the electronic components and possibly the batteries.

The invention does not have to deal with the sealing problem between the upper shell and the lower shell, because the electronic components which are highly sensitive to dirt and moisture, which may also include the electric batteries, are enclosed by a housing-like capsule, with which they form a prefabricated structural unit, referred to below in short as the "electrocapsule". The components inside the electrocapsule are sealed off on all sides. If needed, the electronic components can be embedded in the electrocapsule. This electrocapsule is independent of the sealing function and therefore presents no sealing problems for the key container. The electronic components and their electric batteries are housed in the interior of the electrocapsule and are thus protected from the outside. The electrocapsule can be plugged quickly and easily into the free space of the key container and removed again without the need to take apart the two-shell key container. The electrocapsule can be put on the market as a separate commercial product, which can be bought by the owner of the key and installed on the key container, which always remains closed.

Both the key container with its opening and the electrocapsule are prefabricated independently and can be put together and taken apart at any time. Because the key container does not need to be separated into its two shells, it presents no sealing problems. After the electrocapsule has been plugged in, it is unimportant whether the key container is sealed or not, because the only components in it such as the flat mechanical key are insensitive to dirt and moisture. The opening in the key container is closed by the plugged-in electrocapsule. The electrocapsule fits together with the key container to form a complete combination housing, which is manipulated as a single unit when the key is used. The surface of the combination housing used for manipulation is therefore formed in part by the key container of the mechanical flat key and in part by the remaining exposed outside surface of the electrocapsule. Flush joints will be provided at the transitions between the two parts.

BRIEF DESCRIPTION OF THE DRAWINGS

Additional measures and advantages of the invention can be derived from the subclaims, from the following description, and from the drawings. An exemplary embodiment of the invention is illustrated schematically in the drawings:

DETAILED DESCRIPTION OF THE PREFERRED EMBODIMENTS

Figures 1, 2:
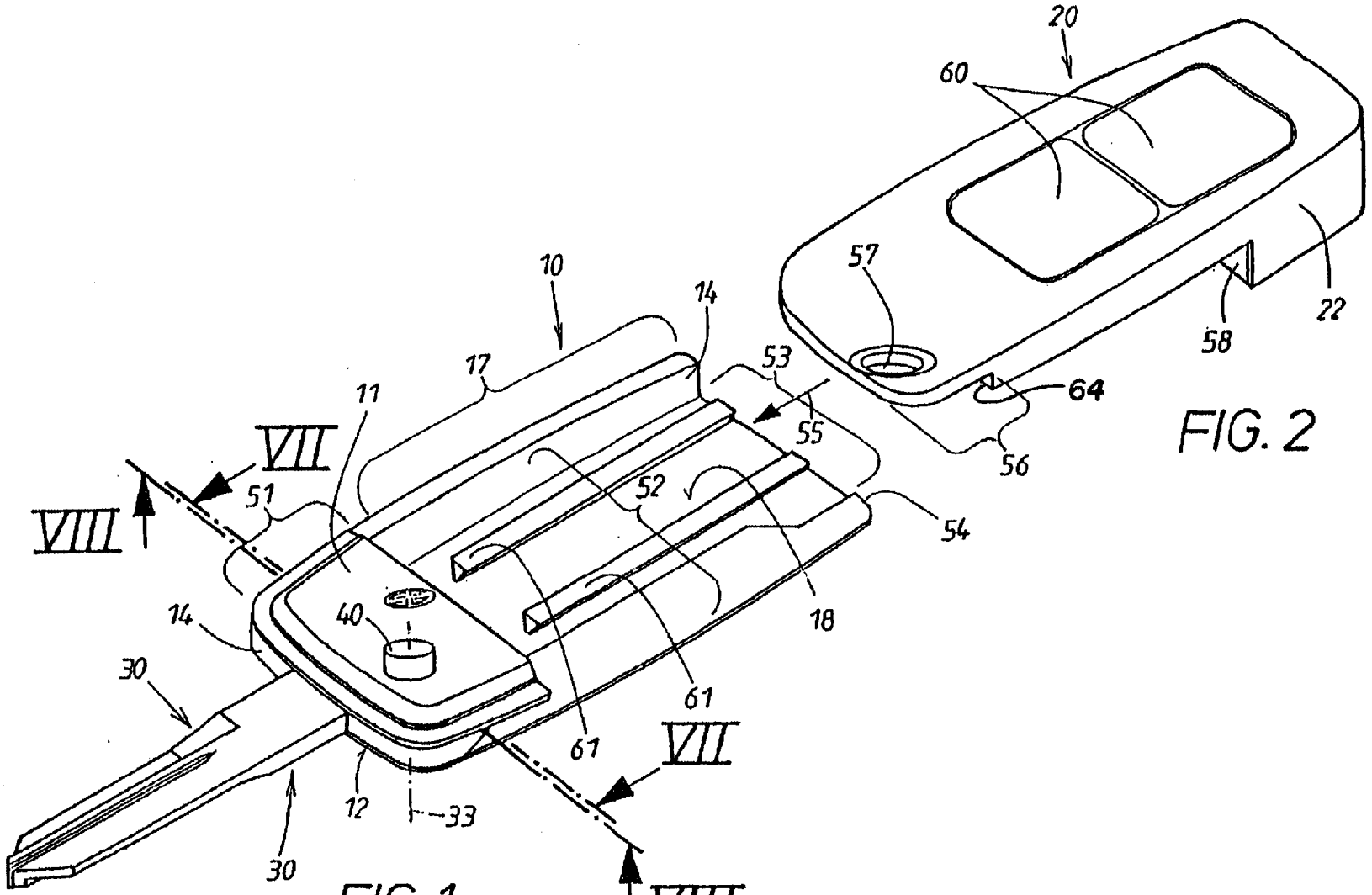
FIG. 1 shows a perspective view of the key container, from which mechanical flat key projects.
FIG. 2 shows another perspective view, this time of a plug-in unit belonging to the flat key of FIG. 1, consisting of an electronic capsule enclosing the electronic components.

The combination key according to the invention allows both the mechanical and the electronic actuation of a lock (not shown). It consists of two parts 10, 20, each prefabricated separately, which are then inserted into each other. The one part 10 comprises the mechanical closing means and consists of a key container 10, the components of which can be seen most easily in the exploded diagram of FIG. 4. The other part 20 is a plug-in unit, to be described in greater detail below, which holds in its interior the electronic components 21, indicated in cross section in FIG. 9.

Figure 4:
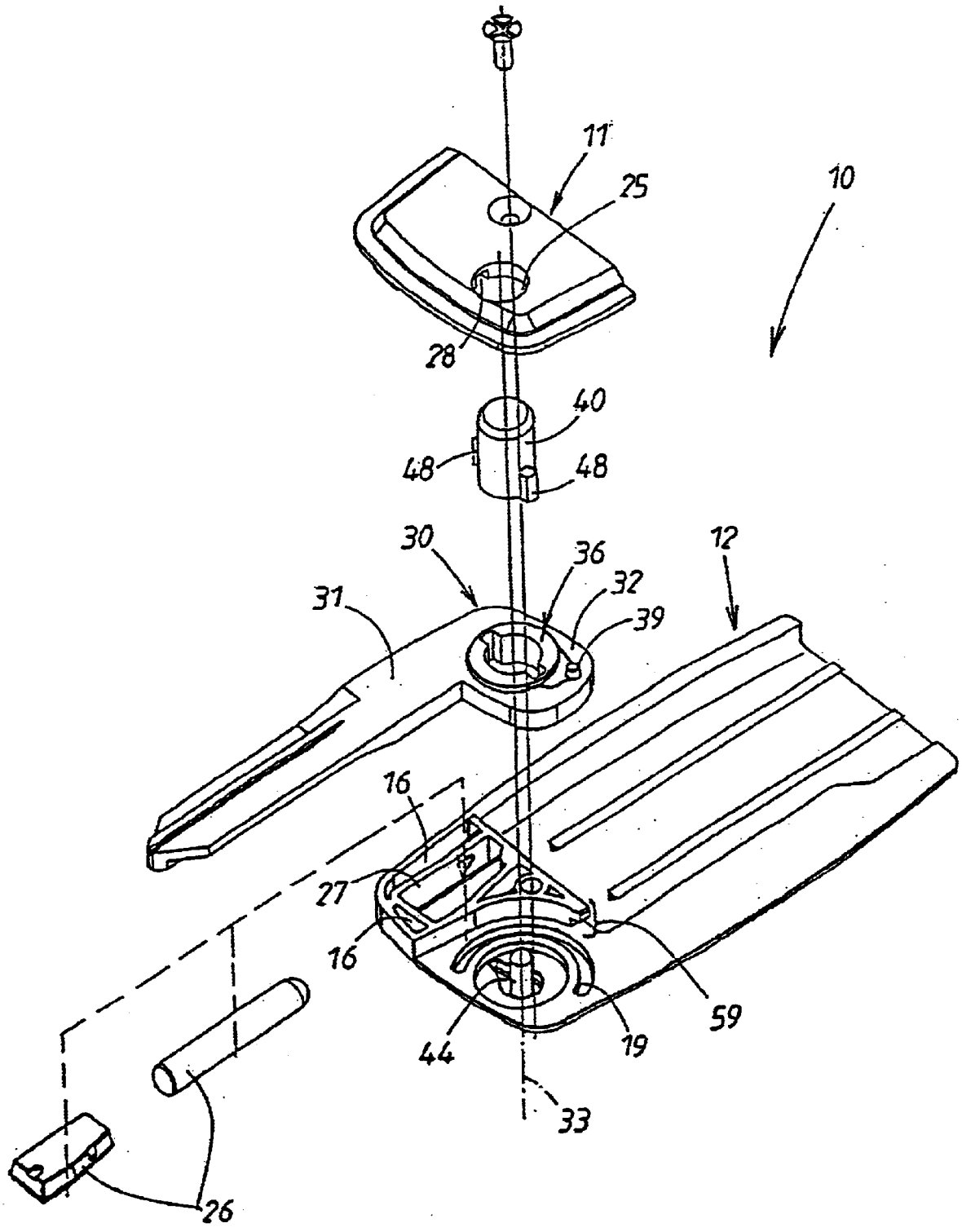
FIG. 4 shows an exploded view of some of the essential parts of the key container shown in FIG. 1, along with the mechanical flat key, before the parts have been assembled.
Figure 7:
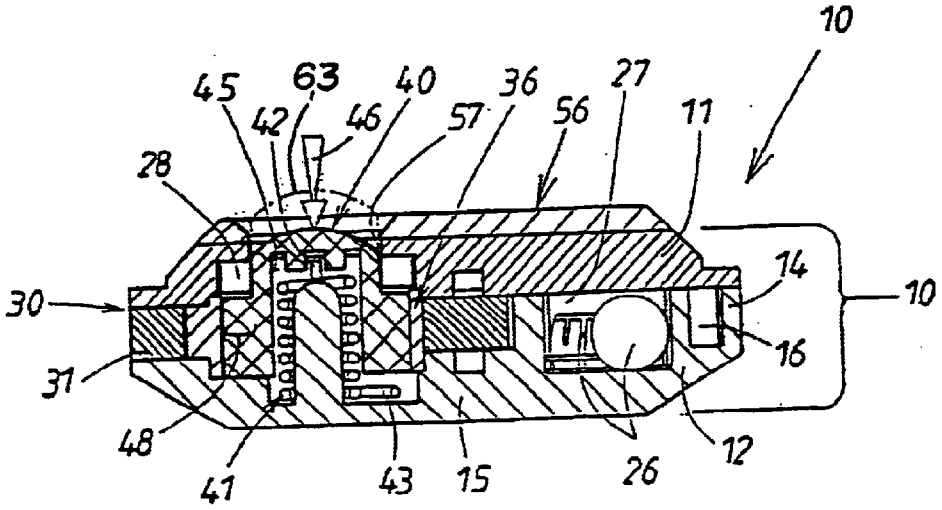
FIG. 7 shows a cross section through the assembled key container of FIG. 1 along the cross-sectional line VII—VII shown there, where the push button is seen in its pushed-in position.
Figure 8:
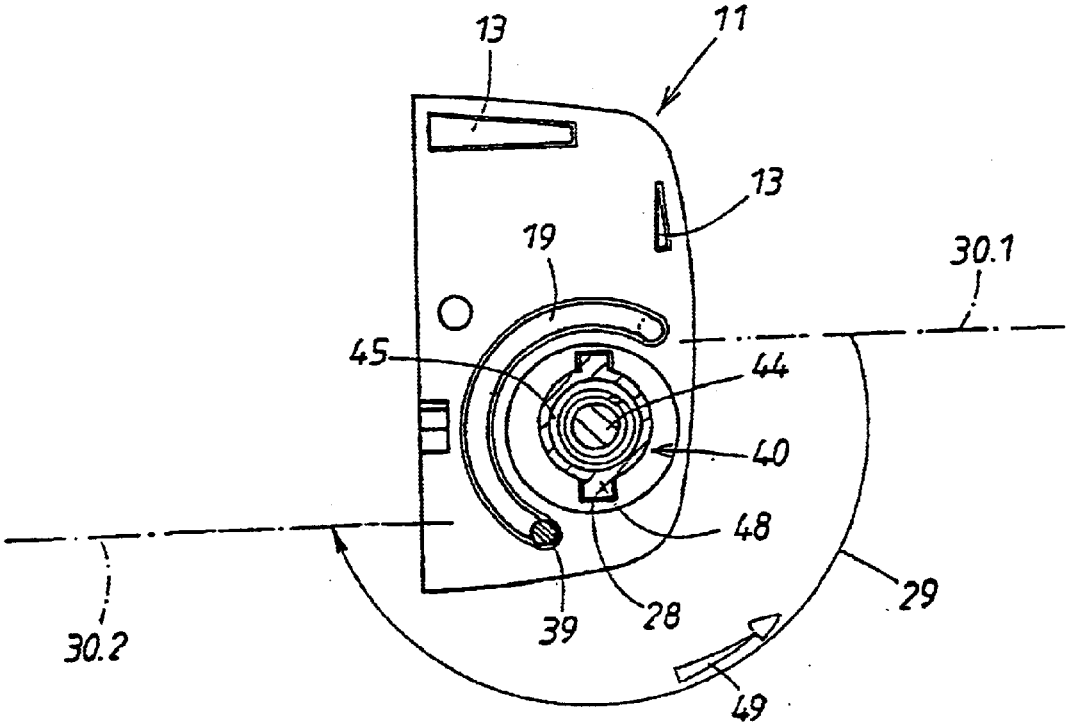
FIG. 8 shows an axial cross section through the key container shown in FIG. 1 along the cross-sectional line VIII—VIII shown there.

As can be seen on the basis of FIGS. 1 and 4, the mechanical part comprises, first, a two-shell key container 10. Whereas the upper shell 11, as can be seen in FIGS. 7 and 8, is designed as a flat plate with connecting projections 13 at various points on its inside surface, the lower shell 12 comprises side walls 14 and a bottom part 15. Connecting sockets 16 for the previously mentioned connecting projections 13 on the upper shell 11 are located at various points in the side walls 14. The upper shell 11 extends only over the front end of the key container 10 and has at the rear an open area 17, which creates an empty space accessible from the outside and leading toward the interior 18 of the shell. This is important for the insertion and removal of the plug-in unit 20 to be described in greater detail below.

Figure 5:
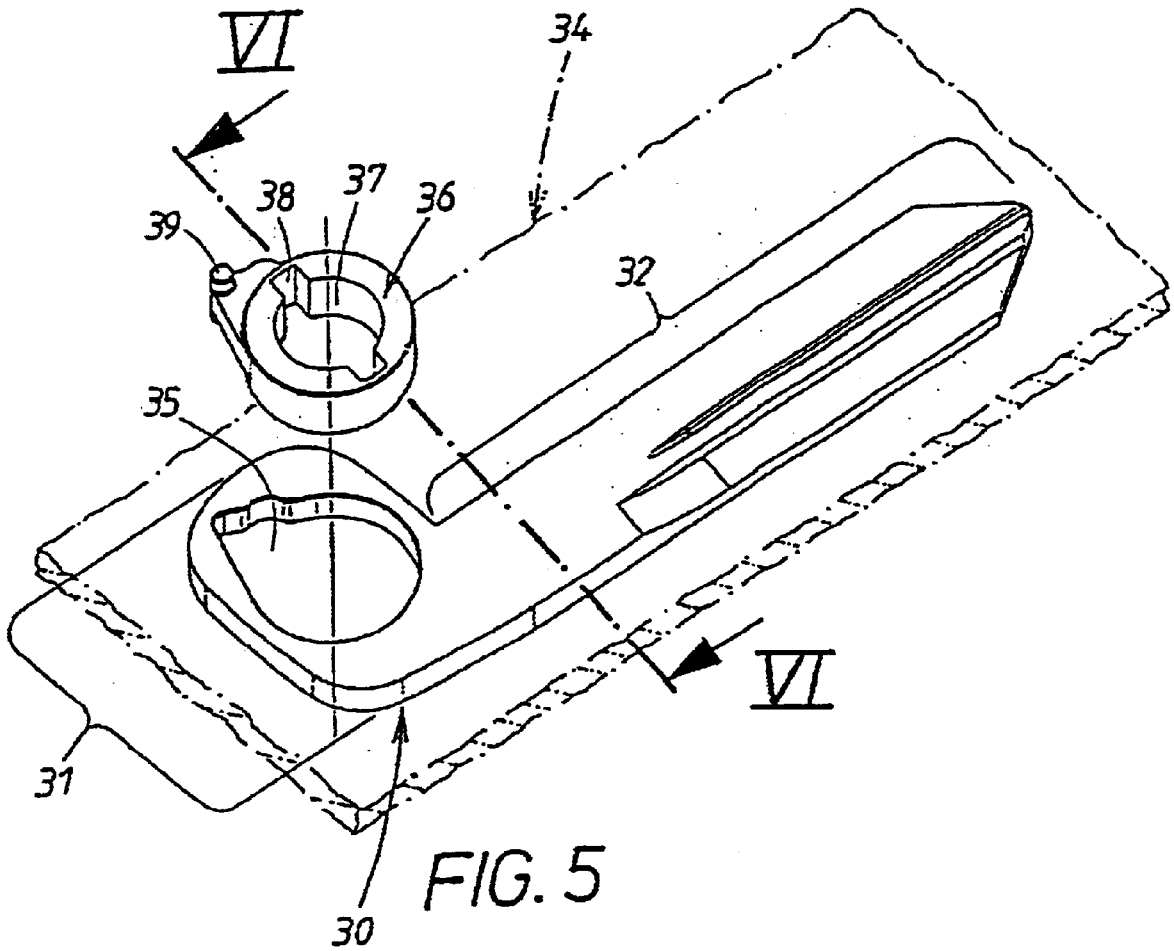
FIG. 5 shows an exploded view of the two components of the mechanical flat key before they are combined.

The key container 10 also includes, as FIG. 4 shows, a mechanical flat key 30, which is installed with freedom of movement, so that it can be moved from a recessed, home position in the container 10 (not shown) into a working position, projecting from the container, as shown in FIGS. 1–4. The flat key 30 is made of metal. Although other types of movement could also be imagined, this flat key 30 is free to pivot around the pivot axis 33, indicated in broken line in FIGS. 1, 3, and 4. The flat key 30 is made as a stamping from a flat plate 34, illustrated in broken line in FIG. 5; the stamping has an L-shaped outline with two sidepieces 31, 32. One of the sidepieces of the L is short and serves to support the flat key 30 at the front end of the key container so that the key can pivot and is therefore referred to in short below as the "support sidepiece". The other sidepiece 32 of the L comprises the actual flat profile of the key shaft, for which reason it is referred to in the following as the "shaft sidepiece". These two sidepieces 31, 32 therefore lie in a common plane, determined by the previously mentioned plate 34; in the final assembled state of the key container 10, this plane is perpendicular to the pivot axis 33. As can be seen in FIG. 5, the support sidepiece 31 is provided with a noncircular plate opening 35, which serves to hold a separate insert 36.

The push button 40 is spring-loaded both in the axial and in the radial direction and has profiles 19, 48, 28 designed to be in agreement with those of the container 10. The insert 36 consists of relatively resilient material, preferably plastic, and has a special counter profile 37, 38, 39 for a push button 40, which determines the position of the pivot axis 33. The spring action is exerted by a combination compression-torsion spring 41, which, as can be seen in FIG. 7, is held in an axial bore 45 in the push button 40. The spring 41 is attached nonrotatably by its one end 42 to the push button 40, whereas the other end 43 of the spring is attached to the lower shell 12 of the container 10. The spring 41 is helical in design. During the assembly process, a mandrel 44, seated on the inside surface of bottom of the lower shell 12, projects into the interior of the spiral and also into the insert 36.

Figure 6:
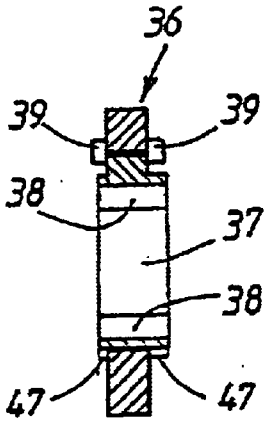
FIG. 6 shows a cross section through the component of FIG. 5 along the cross-sectional line VI—VI shown there.

According to FIG. 5, the flat key 30 and its plate opening 35 are first produced by stamping, and then the insert 36 is inserted vertically into the plate opening 35. After insertion, the insert projects beyond the two flat surfaces of the flat key, as FIGS. 4 and 7 show. In addition, the insert also has cylindrical projections 47, shown in FIG. 6, and stop pins 39, extending from each of the two flat sides and projecting into ring-shaped groove segments 19 in the two shells 11 and 12, as can be seen in FIG. 8. When the stop pin 39 is in the position shown in solid line in FIG. 8, the key is in the previously mentioned working position, after it has been pivoted out of the container 10. Then the previously described shaft sidepiece32 of the flat key 30 extends in the direction of the auxiliary line 30.1 indicated in broken line in FIG. 8, which characterizes the working position of the flat key 30 illustrated in the other figures. In this working position 30.1, the flat key is latched by the push button 40. Then driver wings 48, arranged diametrically in the present case on the push button 40, engage in associated radial grooves 28 in the inside surface of the upper shell 11 and thus secure the flat key 30 in its outward-pivoted position.

Axial grooves 38 in the insert 36 serve as counter profiles for the driver wings 48; these grooves allow an inward-pushing movement in the direction of the force arrow 46 shown in FIG. 7. This inward movement 46, which has been completed in FIG. 7, pushes the push button 40 into its lowered position, as a result of which the driver wings 48 become disengaged from the radial grooves 28. The inward movement 46 takes place against the axial force of the spring 41. The latching of the working position 30.1 is then released. The flat key can then be swung back into its home position in the housing in the direction of the motion arrow 29 of FIG. 8 against the torsional force of the spring 41, illustrated by the force arrow 49 in FIG. 8. Then the shaft sidepiece32 of the flat key 30 lies on the broken line indicated by the number 30.2, as seen in FIG. 8. In this home position 30.2, the shaft sidepiece 32 has disappeared in the lateral gap 24, which can be seen in FIG. 3, of the overall housing 50, to be described in greater detail below, which is formed out of the key container 10 and the plug-in unit 20, which has been inserted into the container. Then the driver wings 48 are again in axial alignment with the radial grooves 28 in the housing; they snap into the grooves under the restoring force of the spring 41 and thus also latch the flat key in this home position 30.2 in the key container 10.

The push button 40 also serves as a pivot bearing for the pivoting movement 29. For this purpose, a bearing bore 25 is provided in the upper shell 11 of the container 10, as can be seen in FIG. 4. This bore is in axial alignment with an axial bore 37 in the insert 36 shown in FIGS. 5, and 6 and with the previously mentioned mandrel 44 on the lower shell 12. The push button 40 determines the pivot axis 33 of the flat key 30. The stop pin 39 on the insert on one side and the ring-shaped groove segment 19 assigned to it on the housing side can also take over rotational guide functions during the pivoting movement 29. In addition, rotational stops can also be realized by the outline profile of the key 30 on the one side and inside surfaces on the two shells 11, 12 on other.

Instead of prefabricating the insert 36, it would also be possible to postfabricate the insert 36 by an injection-molding technique. For this purpose, the described flat key 30 is introduced into an injection mold, in which the insert 36 is then formed in the plate opening 35 by casting. The counter profiling 37, 38, 39, 47 mentioned above is then present again in the same form.

In many applications, a so-called transponder 26 is also desirable in the case of the above-mentioned combination key for electronic actuation. This transponder 26 is intended to individualize the combination key electronically right from the start. When the key is inserted into the associated lock, a communications process take place between the transponder 26 and the lock; if it is found that the lock and the key belong together, the lock functions are initiated immediately. For this reason, transponders 26 of this type are installed in the forward area of the key container 10 in the invention. For this purpose, the lower shell 12 has a chamber 27, into which the transponder(s) 26 can be cemented. Because an electronic power supply is not required for the transponder 26, the final assembled key container 10 of FIG. 1 does not need to be separated into its shells 11, 12 so that the battery can be replaced, etc. The transponders 26 are therefore protected permanently in their chamber 27. This also applies to the previously mentioned additional electronic components 21, which form an internal part of the previously mentioned detachable plug-in unit 20 of the overall housing 50.

Figure 9:
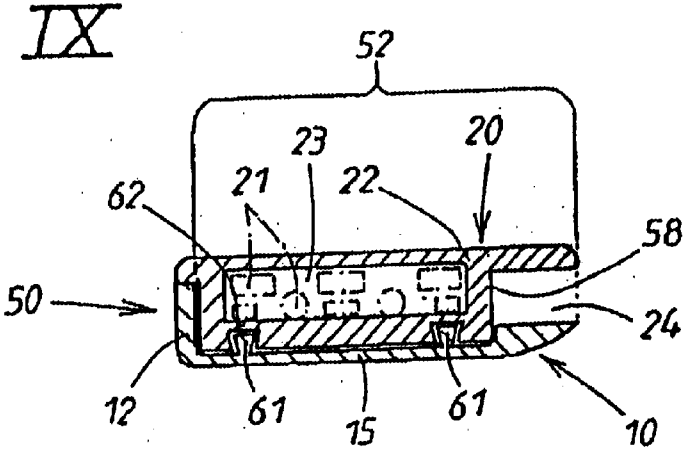
FIG. 9 shows a cross section through the combination housing shown in FIG. 3 along the cross-sectional line IX—IX shown there.

As can best be seen in FIG. 9, a housing-like capsule 22, in the interior 23 of which the components 21 are mounted and thus closed off on all sides from the outside, belongs to the plug-in unit 20. The wiring of the components and possibly the electrical interference can be provided in the interior 23 of the capsule. This structural unit 21, 22, which can be plugged into the key container 10, is prefabricated as a complete unit and is called the "electrocapsule" in the following. For assembly purposes, the key container 10 is shaped to accommodate it as follows.

The previously mentioned open area 17 of the key container 10 is produced simply by allowing the upper shell 11, as seen in FIG. 1, to cover only the forward section 51 of the key container 10. As a result, an open area accessible from the outside and leading to the interior 18 of the shell is created. This open area 17 has not only an upper opening 52 facing upward but also a side opening 53, accessible from the rear 54. This side opening arises because not only the rear section of the upper shell 11 is missing but also, as FIG. 1 shows, the side wall 14 of the lower shell 12 has been omitted at the rear 54 of the container 10. The electrocapsule 20 is pushed through this side opening 53 into the open area 17 of the key container 10 in the direction of the motion arrow 55 of FIG. 1. In its plugged-in position according to FIG. 3, the electrocapsule 20 seals off the upper opening 52. The plug-in movement 55 is on a plane parallel to the above-mentioned pivoting movement 29. The following guide means 61, 62 are provided to guide the insertion and sliding-in movement 55 of the electrocapsule 20.

Figure 3:
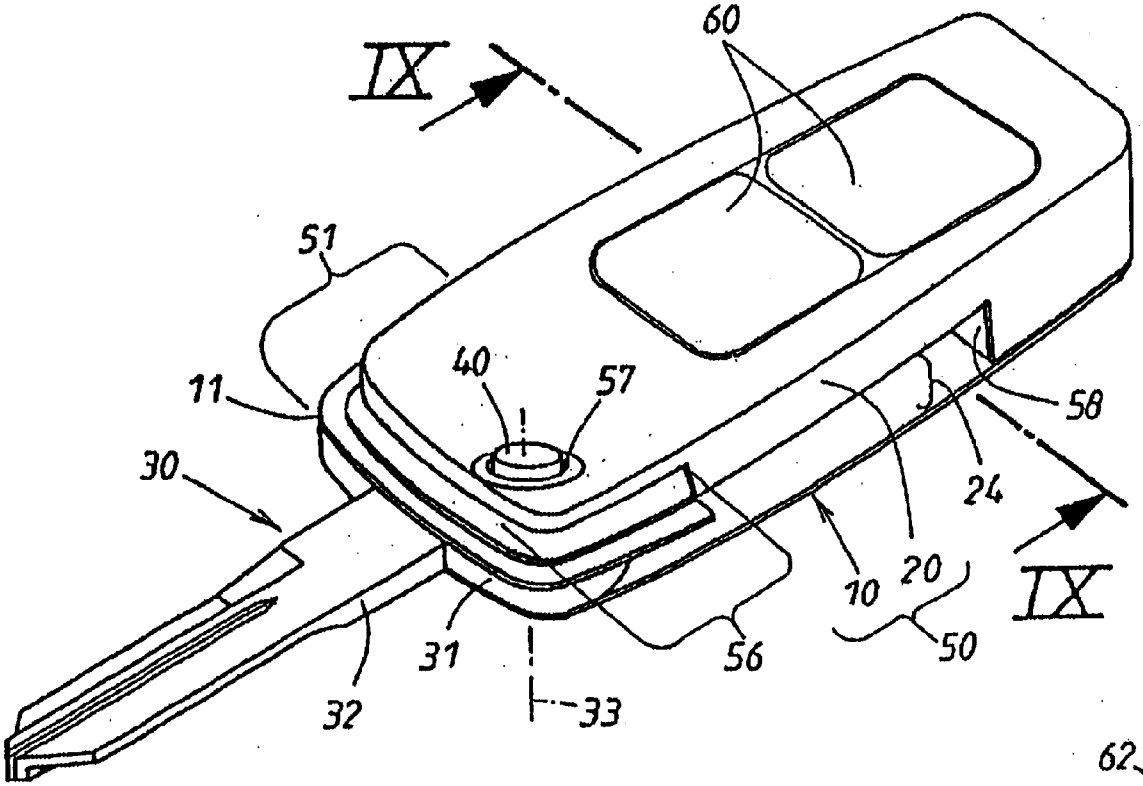
FIG. 3 shows a combination housing, assembled from the key container of FIG. 1 and the plug-in unit of FIG. 2, which is used to manipulate the key during the mechanical and electronic actuating processes.

On the interior surface of the bottom 15 of the lower shell 12, there are two parallel guide strips 61, which extend toward the side opening 53. They are undercut and have preferably a dovetail profile. To these strips are assigned complementary guide grooves 62 in the bottom surface of the housing of the electrocapsule 20. The engagement between these guide means 61, 62 can be seen in the cross section of FIG. 9. One of the long sides of the capsule housing 22 according to FIG. 9 has a step at 58, 30 that, together with a corresponding step 59 in the lower shell 12 according to FIG. 4, the lateral gap 24 for the shaft sidepiece 32 of the flat key 30 is created when the capsule is inserted. In the inserted position according to FIGS. 3 and 9, the external surfaces of the electrocapsule 20 which remain visible on the one side and the external surfaces of the key container 10 which remain visible on the other form a flush transition with each other. The two parts 10, 20 form then the previously mentioned combination housing 50; during the manipulation of the key, the two parts are gripped jointly by the hand. The combination of the two is therefore called the "combination housing". This applies both to the mechanical actuation of the associated lock, when the outward-pivoted shaft sidepiece 32 is turned by means of the combination housing 50, and also to the electronic actuation. For this purpose, actuating points 60 are provided in the common combination housing 50 on the still-visible outside surface of the electrocapsule 20. These can take the form of push button switches or membrane actuating points. These actuation sites can be provided with additional membrane-like covers in the area of the previously mentioned push button 40, to which the following special meaning belongs:

The insertion position of the electrocapsule 20 in the key container 10 shown in FIGS. 3 and 9 is not only limited by stop means 64 but also secured by latching means. This latching function can also be taken over advantageously by the push button 40. For this purpose, the electrocapsule 20, according to FIG. 2, is extended at the front by a tab 56, which, when in the inserted position of FIG. 3, covers the remaining forward section 51 of the upper shell 11 of the key container 10. The tab 56 has an opening 57, into which the axially spring-loaded push button 40 snaps when the electrocapsule 20 according to FIG. 3 is plugged into position. As a result, it is ensured that the key container and the electrocapsule 20 will be held securely together. The opening 57 passes through the tab 56, for which reason, after the parts have engaged as shown in FIG. 3, a longitudinal piece of the push button 40 sufficient for actuation projects out from the tab 56. To disassemble the combination housing 50 into its component parts 10, 20, the push button 40, as shown in FIG. 7, is pushed in the direction of arrow 46 until it disengages from the opening 57 in the tab 56.

The push button 40 can be covered by a membrane 63 in the area of the tab 56, which membrane functions in the same way as for the actuating points 60. These membranes of the actuating points 60 can be combined with the previously mentioned membrane in the area of the push button.

List of Reference Numbers

| | |
|---|---|
| 10 | first key part, key container |
| 11 | upper shell of 10 |
| 12 | lower shell of 10 |
| 13 | connecting projection on 11 |
| 14 | side wall of 12 |
| 15 | bottom of 12 |
| 16 | connecting receptacle in 12 |
| 17 | open area of 11, free space in 18 |
| 18 | interior of shell |
| 19 | profile in 11, 12 for 39, ring-shaped segment |
| 20 | second part of key, plug-in unit, electrocapsule |
| 21 | electronic component |
| 22 | housing-like capsule for 21 |
| 23 | interior of capsule for 22 in 21 |
| 24 | lateral gap in 50 for 32 (FIGS. 3, 9) |
| 25 | bearing bore in 11 for 40 (FIG. 4) |
| 26 | transponder |
| 27 | recess in 11 for 26 (FIG. 4) |
| 28 | profile in 11 for 48 of 40, radial groove (FIG. 7) |
| 29 | pivoting movement arrow for 30 (FIG. 8) |
| 30 | mechanical flat key for 10, stamping |
| 30.1 | working position of 32 (FIG. 8) |

-continued

| List of Reference Numbers | |
|---|---|
| 30.2 | home position of 32 (FIG. 8) |
| 31 | first L-sidepieceof 30, support sidepiece |
| 32 | second L-sidepieceof 30, shaft sidepiece |
| 33 | pivot axis for 30 |
| 34 | flat plate for 30 |
| 35 | plate opening |
| 36 | insert in 35 |
| 37 | counter profile in 36, axial bore (FIGS. 5, 6) |
| 38 | counter profile of 36, axial groove in 36 for 48 (FIGS. 5, 8) |
| 39 | counter profile of 36, guide or stop pin (FIGS. 5, 6) |
| 40 | push button |
| 41 | compression-torsion spring for 40 |
| 42 | first end of spring 41 (FIG. 7) |
| 43 | second end of spring 41 (FIG. 7) |
| 44 | mandrel on 12 for 41 (FIG. 4) |
| 45 | axial bore in 40 for 41 |
| 46 | arrow of the pushing-in movement of 40 (FIG. 7) |
| 47 | counter profile on 36, cylindrical shoulder on 36 (FIG. 5) |
| 48 | profile, driver wing on 40 |
| 49 | arrow of the outward-pivoting force of 41 for 30 (FIG. 8) |
| 50 | overall housing consisting of 10, 20, combination housing |
| 51 | forward section of 10 |
| 52 | upper opening of 10 at 17 (FIG. 1) |
| 53 | side opening in 11 (FIG. 1) |
| 54 | rear of 10 |
| 55 | arrow of the insertion movement of 20 into 10 (FIG. 1) |
| 56 | tab on 20 (FIG. 2) |
| 57 | opening in 56 for 40 (FIG. 2) |
| 58 | inside step on 22 for 24 (FIGS. 2, 9) |
| 59 | step on 12 for 24 (FIG. 4) |
| 60 | actuating point on 20 (FIG. 1) |
| 61 | guide means on 12, guide strip |
| 62 | guide means on 20, guide groove |

What is claimed is:

1. In a combination mechanical and electronic key, especially for locks in motor vehicles, with a common key container (10) to be manipulated when actuating the lock, containing a flat key (30) for the mechanical actuation of the lock;

where the flat key (30) is held with freedom of motion (29) in the container and can be moved from a home position (30.2), recessed in the container (10), to a working position (30.1), projecting from the container (10); and with an axially spring-loaded (41) push button (40), which is mounted in the container (10) and which latches the key (30) in at least one of these positions (30.1, 30.2);

where the key container (10) consists of an upper shell and a lower shell (11, 12), which are attached to each other at least in certain areas, wherein the improvement comprises that the upper shell (11) has an open area (17) in the part situated outside the push button (40);

the open area creates a free space (17) in the interior of the shell (18), which is accessible from the outside;

the electronic components for the electronic actuation of the lock, their wiring, and their electrical controls are enclosed by a housing-like capsule (22) and with this forms a prefabricated electrocapsule (20);

the electrocapsule (20) forms a plug-in unit, which can be inserted (55) at a later time into the free space (17) of the final assembled key container (10) and held in place there;

the electrocapsule (20) has a tab (56) extending from the front end; wherein when the capsule (20) is in the inserted position, the tab (56) covers at least certain areas of the latching piece (51) of the upper shell (11) located in front of the upper opening (52) of the key container; and the tab (56) has an opening (57), into which the spring-loaded (41) push button (40) enters in the axial direction to secure the inserted position of the electrocapsule (20) in the key container (10).

2. Key according to claim 1, wherein, on its exposed surface, the plugged-in electrocapsule (20) has actuating points (60) in the open area (17) for the actuation of the electronic components (21) located inside the capsule.

3. Key according to claim 1, wherein the plugged-in electrocapsule (20) closes off the opening (17) in the key container (10), and in that the plug-in combination of the electrocapsule (20) and the key container (10) produces a combination housing (50) with a peripheral surface with flush transitions.

4. Key according to claim 1, wherein the open area (17) not only produces an upward-facing upper opening (52), which arises through the omission of the rear section of the upper shell, but also extends over a lateral opening (53), which arises through the omission of at least certain parts of the side wall (14) of the lower shell (12) and of the upper shell (11); and the electrocapsule (20) can be inserted through the lateral opening (53) into the free space (17) of the key container (10) and, when in the inserted position (55), also closes off at least certain areas of the upper opening (52).

5. Key according to claim 1, where the flat key (30) can be pivoted between its home position and its working position (30.2; 30.1) in the container (10);

where the push button (40) serves as a pivot bearing (33) for the flat key (30), and where its spring-loading (41) tries to pivot the flat key (30) outward (49) into its working position (30.1); wherein the insertion direction (55) of the electrocapsule (20) into the key container (10) is on a plane which is parallel to the plane of the pivoting motion (29) of the flat key (30).

6. Key according to claim 4, wherein the side opening (53) into which the electrocapsule (20) is inserted (55) is located at the rear (54) of the key container (10), i.e., the end opposite that where the push button (40) is located.

7. Key according to claim 4, wherein the lower shell (12) and the electrocapsule (20) have guide means (61, 62) for the controlled introduction and sliding-in (55) of the electrocapsule (20); and the guide means (61, 62) point toward the side opening (53) of the lower shell (12).

8. Key according to claim 7, wherein the guide means (61, 62) in the lower shell (12) are undercut with respect to the upper opening (52) of the key container (10).

9. Key according to claim 7, wherein the guide means consist of at least one guide strips (61), which have a dovetail profile; and the electrocapsule (20) has guide grooves (62) complementary to the strips.

10. Key according to claim 1, wherein the plugged-in position of the electrocapsule (20) in the key container (10) is limited by stop means (64) and is secured by latching means.

11. Key according to claim 1, wherein the opening (57) passes through the tab (56); and after the electrocapsule (20) has been plugged in, the actuating end of the push button (40) projects out from the top of the tab so that it can be actuated.

12. Key according to claim 11, wherein, on the push button (40) and on its seat (44) in the key container (10), control means (41, 48, 38, 37) are provided, which, after the push button (40) has been pushed in axially, hold the push button (40) in position during the pivoting (29) of the flat key (30) between the working and home positions (30.1; 30.2); and when in this pushed-in position, the push button (40) is disengaged from the opening (57) in the tab (56) and releases the electrocapsule (20).

13. Key according to claim 11, wherein the tab (56) has a membrane (63) in the area of its opening (57), which membrane covers the top surface of the push button after the electrocapsule (20) has been plugged in; and this membrane forms the manual actuating point for the push button (40).

14. Key according to claim 13, wherein the membrane is designed to form a single piece with the tab (56) of the electrocapsule (20).

15. Key according to claim 14, wherein the membrane serving to actuate the push button (40) is combined with additional membrane-like actuating points (60) in the key housing (10) or on the outside surface of the electrocapsule (20), namely, the surface which remains visible after the capsule has been plugged in, which points serve to actuate the electronic components (21) in the electrocapsule (20).

* * * * *